US005313857A

United States Patent [19]

Weisband

[11] Patent Number: 5,313,857

[45] Date of Patent: May 24, 1994

[54] OPENER/CLOSURE FOR SCREW TYPE CONTAINER CAPS

[76] Inventor: Richard Weisband, 3938 E. Grant Rd. #262, Tucson, Ariz. 85712

[21] Appl. No.: 49,355

[22] Filed: Apr. 21, 1993

[51] Int. Cl.[5] ..... B67B 7/18

[52] U.S. Cl. ..... 81/3.31; 81/3.42

[58] Field of Search ..... 81/3.07, 3.25, 3.31, 81/3.32, 3.36, 3.4, 3.42

[56] References Cited

U.S. PATENT DOCUMENTS

| | | | |
|---|---|---|---|
| 2,406,107 | 8/1946 | Seals | 81/3.3 |
| 2,569,239 | 9/1951 | Holmen | 81/3.32 |
| 2,732,740 | 1/1956 | Holmen | 81/3.32 |
| 2,854,872 | 10/1958 | Hastings | 81/3.3 |
| 2,897,699 | 10/1958 | Anderson, Jr. | 81/3.33 |
| 3,950,801 | 4/1976 | Morrison | 81/3.3 |
| 4,334,332 | 6/1982 | Downs | 81/3.44 |
| 4,523,497 | 6/1985 | Rosberg | 81/3.44 |
| 4,762,029 | 8/1988 | Chen | 81/3.2 |
| 4,852,431 | 8/1989 | Frangel | 81/3.2 |

FOREIGN PATENT DOCUMENTS 788935 1/1958 United Kingdom .

*Primary Examiner*—Roscoe V. Parker

[57] ABSTRACT

The opener/closure of the present disclosure relates to devices permitting the opening or closing of twist cap containers. It comprises a rectangular housing in which a pair of cap gripping jaws are slidably mounted for movement toward and away from each other, and in which the jaws are interconnected by a cable in a manner whereby movement of one jaw in one direction is effective to move the other jaw in the opposite direction, whereby when moved toward each other both cooperate to grip a container twist cap either for loosening or tightening the cap to open or close its container. A standard positions the container below the housing by a strap tightly holding it securely against rotation as the jaws grip the cap, and the housing is manually rotated to loosen or tighten the cap on the container.

15 Claims, 4 Drawing Sheets

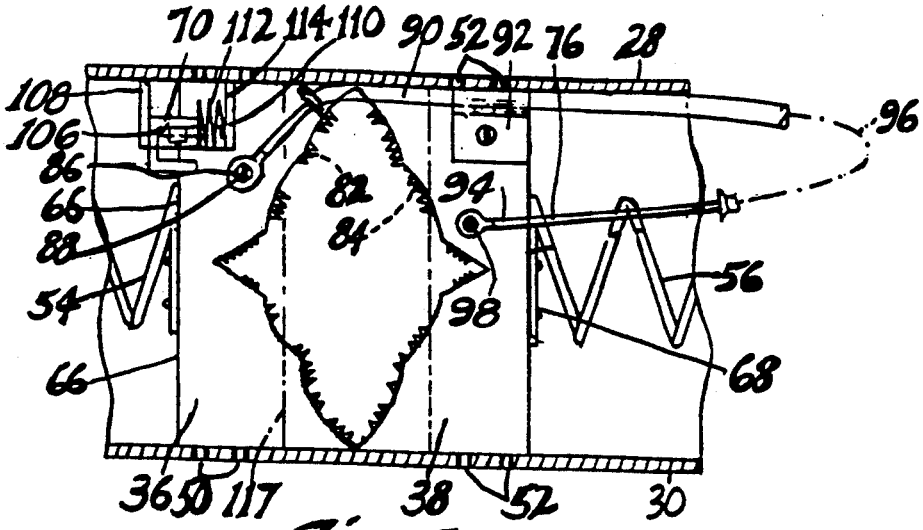
Fig. 5A
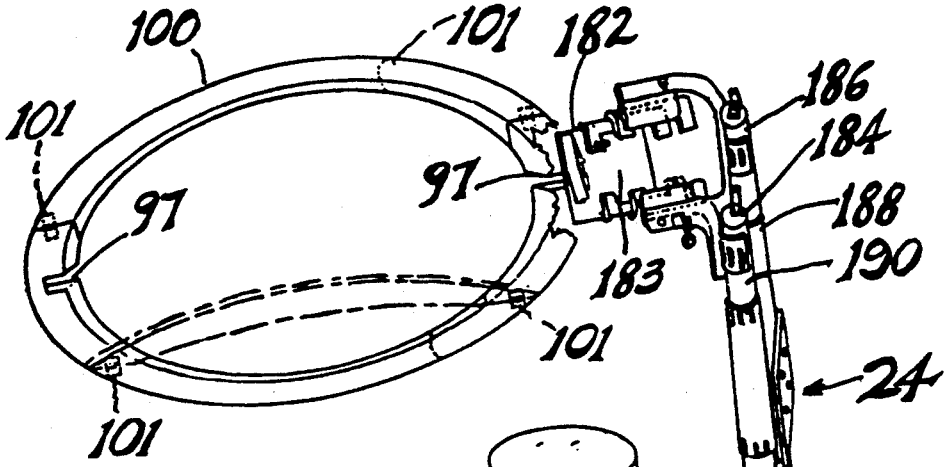
Fig. 6
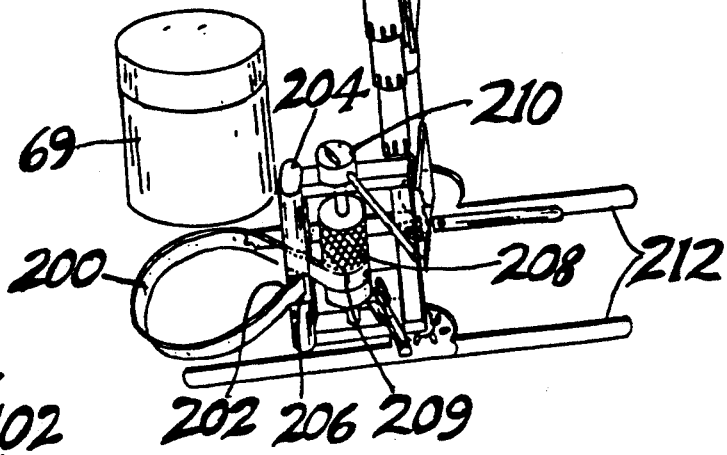
Fig. 7
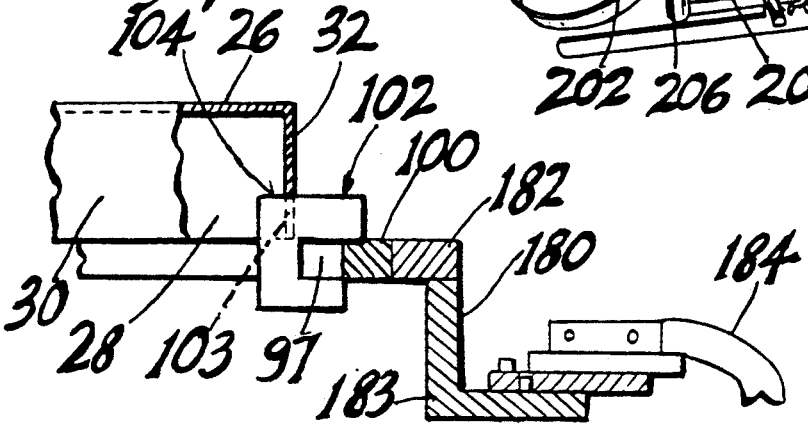

OPENER/CLOSURE FOR SCREW TYPE CONTAINER CAPS

BACKGROUND OF THE INVENTION

The present invention relates to a device for opening or closing screw threaded twist caps used on product containers of various sizes.

While it is to be clearly understood that it relates to both functions, opening and closing, for simplicity in describing the invention hereinafter, for the most part it will primarily be designated only with the opening function as "opener".

Because of the possibility of someone maliciously polluting a container's contents in the market place, producers of products packaged in twist cap containers have resorted to initially twisting the caps on their containers tightly enough to prevent that possibility.

However tight caps make it difficult for users, particularly the young and old, to loosen and open the caps by hand when desiring to use the container's contents.

Some inventors in the past, as evidenced by the patented prior art, have offered solutions to this difficulty, but seemingly none have reached the market to solve the difficulty.

Therefore, it is the primary object of the present invention to provide a twist cap opener which overcomes the difficulty of loosening twist caps on product containers of a wide variety of sizes, by providing one which is simple to operate, and positive in its results.

More specifically, it is an object of the invention to provide such a twist cap opener which makes it easy for anyone, but more particularly the young and old, easily and quickly to loosen such twist caps so that the associated container may be opened and its contents available for use.

Still further it is an object of the invention to provide a twist cap opener which is quickly foldable for easy storage in a kitchen utensil drawer, or other kitchen cabinet structure, or still further, mounted upon a kitchen wall.

BRIEF DESCRIPTION OF THE DRAWINGS

To clearly define the invention and make it easily understood, it has been illustrated in the accompanying drawings and described in the following specification.

In the drawings:

FIG. 5A is a fragmentary sectional view of a portion of the opener showing the cap gripping jaws and associated mechanism;

FIG. 6 is a perspective view of the container holding component showing how it is connected to the opener;

FIG. 7 is a fragmentary view showing how the container component is connected to the opener;

DETAILED DESCRIPTION OF THE DRAWING

Figure 1:
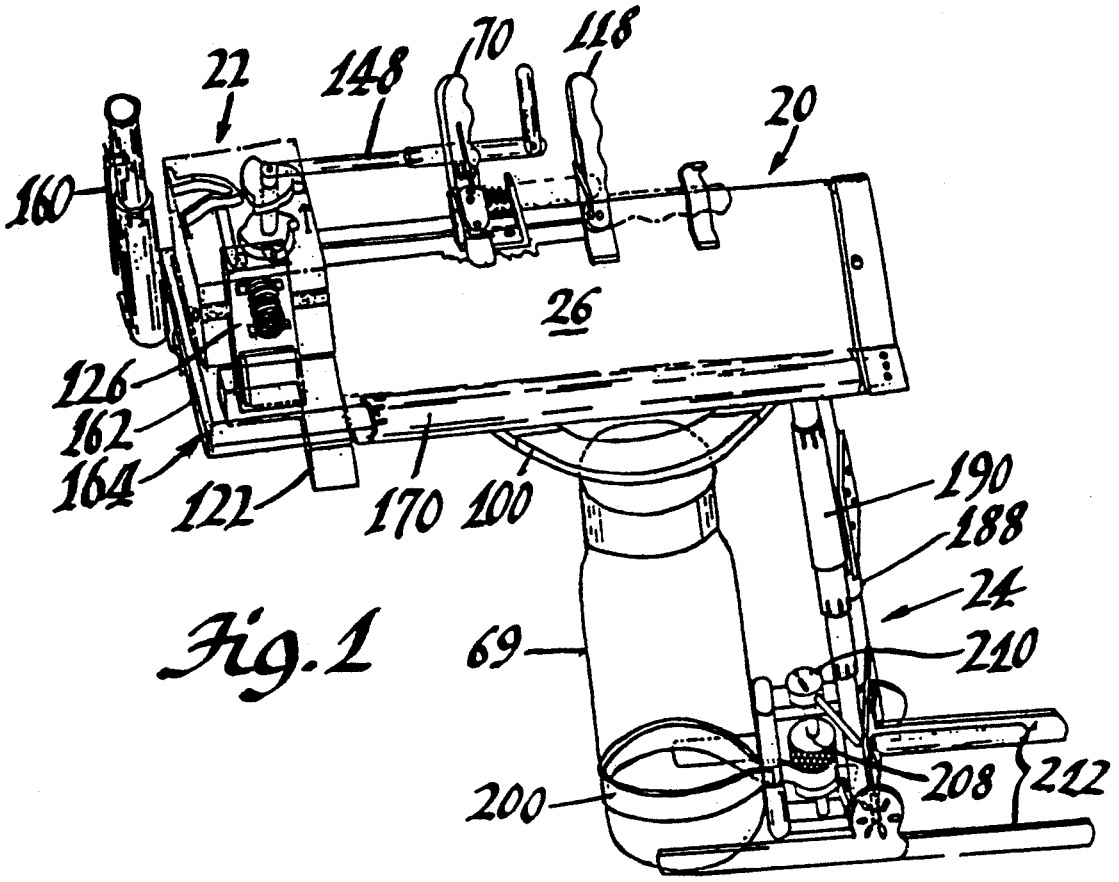
FIG. 1 is a perspective view of the assembled opener showing its three basic components.

Referring first to FIG. 1, it is seen that the preferred best form of the invention comprises three basic components, namely: the opener component 20 for twisting the twist caps to open its container; the intermittent striker component 22 for assisting the opening operation; and the container component 24 for placing a container twist cap into position in the opener for loosening the cap for opening the container.

Figure 2:
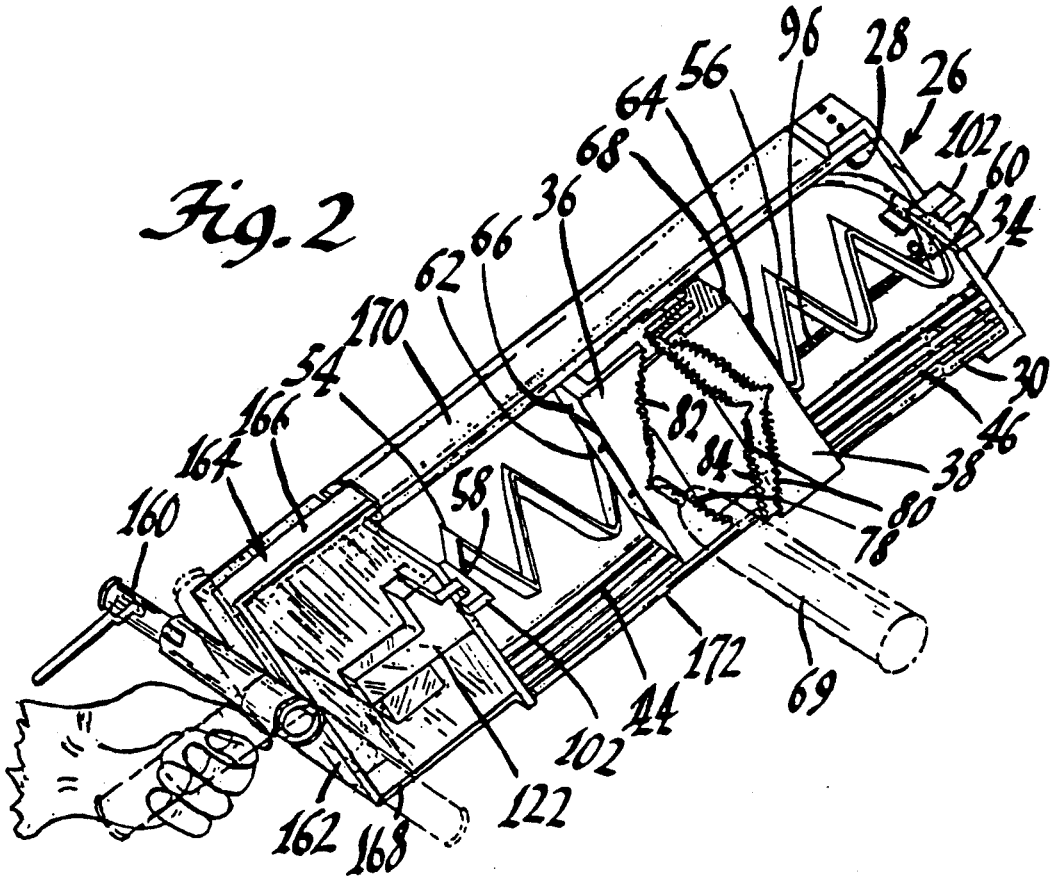
FIG. 2 is also a perspective view of the opener but looking upward from its bottom, and showing details of the twist cap gripping jaw elements.

More specifically, the opener component 20 comprises a rectangular housing 26 having opposite downturned side edge flanges 28 and 30, one downturned end flange 32, with its opposite end closed by a flange member 34, all as seen more clearly in FIG. 2, to which attention is now directed.

Figure 5:
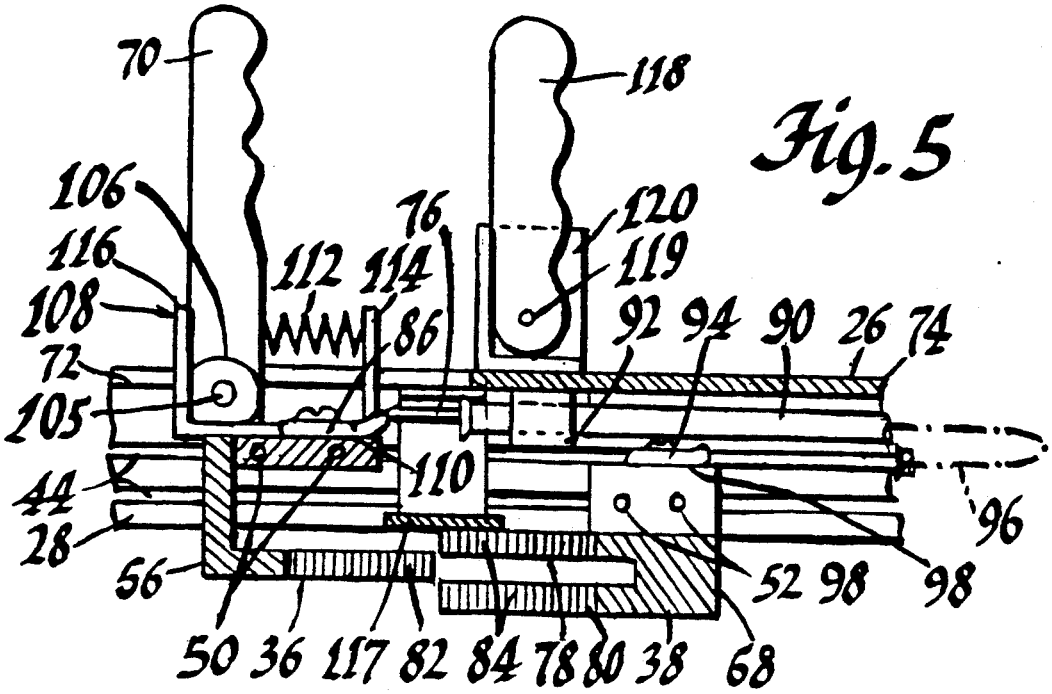
FIG. 5 is a fragmentary sectional view of the opener showing details of the cap grippers and how they are operated to loosen a container twist cap.

Positioned within housing 26 are the container cap gripping jaws 36 and 38 which are slidably carried on the downturned side edge flanges 28 and 30, by means of slots 44 and 46 in both side edge flanges, and pins 50 and 52 projecting into slots 44 and 46 from opposite sides of gripper jaws 36 and 38 respectively, as shown in FIG. 5 and 5A. It will be noted that the jaws extend downwardly beneath the side edge flanges of housing 26. This permits the accommodation of containers with caps larger than the width between the side edge flanges of housing 26 and the jaw totally within the housing between the side edge flanges.

Accordian type springs 54 and 56 are arranged on opposite sides of the jaws with their outer ends 58 and 60 secured to end flanges 32 and 34, and their inner ends 62 and 64 secured to opposite sides 66 and 68 of the jaws, respectively.

Movement of the jaws toward each other in order to engage the lid of a container 69 placed in position beneath the housing and in line with the center of the jaws, with it cap positioned between the jaws for engagement by the teeth 82 and 84 on the facing edges of the jaws, is obtained by the pivotally mounted handle 70, see FIG. 5, extending upwardly through slot 72 in the top wall 74 of housing 26 and above it to provide handle means by which the jaws may be moved toward and away from each other.

As jaw 36 moves to the right, urged by accordian spring 54 (FIG. 2) and handle 70, as seen in FIG. 5, cable 76 is effective to move jaw 38 to the left toward jaw 36, assisted by accordian spring 56 (see FIG. 2), at which time jaw 36 moves between, and merges with the spaced parallel grippers 78 and 80 of jaw 38, thus to effect gripping of a container lid by the teeth 82 and 84 provided on the leading edges of the jaws, when the container is positioned between them.

As shown in FIG. 5A, the gripping edges of the jaws are formed by a V-shaped center portion and two different radii on each side of the center portion, the purpose of which is to accommodate twist caps of different radii for loosening and opening its container.

To effect the above described movement of the jaws, it will be seen that the left end 86 of cable 76 is fastened to jaw 36 and extends through sleeve 90 fixed to the top of housing 26 by a member 92. The right end 94 of the cable passes through the reverse turned end 96 of sleeve 90 and is fixed to jaw 38 at 98.

In FIGS. 6 and 7, it will be seen that the C-shaped elements 102 have a lower leg shorter than its upper leg. This arrangement permits easy assembly of the opener component upon ring 100, by dropping the shorter legs through notches 97 on opposite inner sides of the ring, until the longer upper leg comes to rest upon the top of the ring in line with the bottom of the housing flanges, only one of which (32) is shown here, when housing 26 is rotated on the ring to twist a container cap.

Figure 9:
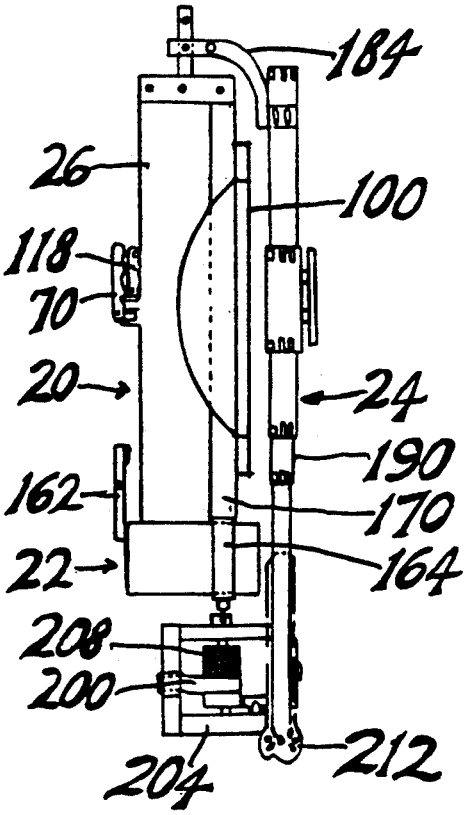
FIGS. 9 is a view of the completed invention showing it folded for convenient and compact storage, or even hanging upon a wall.

Note in FIG. 6 that the opposite sides of ring 100 are hinged at 101 whereby these portions of the ring may be folded up for compact storage, as seen in FIG. 9.

As mentioned above, housing 26 is mounted upon ring 100, see FIGS. 6 and 7, and secured thereto by a plurality, preferably two of the C-shaped elements 102 secured in notches 97 to the downturned edge flanges of housing 26, as at 104, and straddling the ring, all as shown in FIG. 7, thus permitting controlled rotational movement of the housing on the ring, whereby, when a container is positioned beneath the housing and its twist cap is securely gripped by the jaws 36 and 38, and the housing 26 is rotated the twist cap will be loosened for easy removal and opening of its container.

On the other hand, opposite rotation of the housing on the ring may be used to effect tightening of a twist cap on its container.

Now returning to FIG. 5 in which the accordian springs have been omitted for clarity's sake, it is seen that handle 70 is pivotally mounted at 105 to the upright 106 carried upon an upstanding U-shaped bracket 108 fixed upon the top of jaw 36 at 110. A spring 112 is positioned between the righthand leg 114 of bracket 108 and handle 70. The lefthand leg 116 extends upwardly beyond the pivotal mounting of the handle to prevent rotation of the handle counter-clockwise to the left beyond its vertical position, as shown in this figure.

A second handle 118 is pivotally mounted at 119 upon the top of housing 26 by means of bracket 120 in a manner to prevent its rotation in a counter-clockwise direction but permitting its clockwise rotation.

When initiating operation of the opener, handle 70 is grasped and pulled to the left moving jaw 36 in that direction against and loading accordian spring 54. At the same time cable 76 is effective to move jaw 38 to the right, both cooperating to open the jaws to receive a twist cap of a container in position to be grasped by the jaws when handle 70 is released, permitting the force of the accordian springs to move the jaws together aided by the simultaneous manual moving of handle 70 to the right.

After the jaws reach and contact the twist cap to be loosened and opened, handles 70 and 118 are grasped by one hand of the operator, and squeezed urging handle 70 clockwise against spring 112 thus to continue the movement of the jaws toward each other sufficient firmly to embed the teeth 82 and 84 into the cap. The strength of this movement is enhanced by the tension of spring 112 which resists excessive pivotal movement of handle 70. It will be understood that the teeth on the central V-shaped portion of the gripper edges preferably are smaller than those on the other portions of the edges, but these smaller teeth are best suited to grasp small caps, as seen in FIG. 2.

In other words, to provide the most hand power to the jaws when gripping a cap, the second handle 118 is fixed to the top wall of the housing 26 slightly to the right of handle 70. With this arrangement when gripping handle 70 and wrapping the fingers of the hand around handle 118 permits the user to apply the necessary force to pivot handle 70 about its pivotal point against spring 112, thus to move the jaw teeth firmly against and imbed them into the twist cap. In order to position the caps vertically between the jaws, a flat plate 117 is fixed immediately above the jaws with its ends secured to the housing side flanges.

Now again with reference to FIG. 6, it will be seen that at the bottom of the telescoping standard 24 there is provided strap means for firmly gripping a container 69 to place it in position beneath housing 26 with its cap between the gripping jaws 36 and 38 of the opener, and to hold it securely against rotation as the housing 26 is rotated to loosen the cap for opening the container.

This feature comprises a flexible strap 200 having one end 202 fixed to housing 204 at 206, with its other end wrapped around spindle 208 for increasing or decreasing the size of its loop. There is provided sufficient length of the strap wrapped around spindle 208 to form loops of sufficient size to accomodate a wide variety of different size containers within its loop. The adjustment of the size of the loop is obtained by rotating the spidle by ratchet 210 on top of housing 26, or the knurled portion around the spindle while the ratchet is in its neutral condition.

Ratchet 210 is of standard construction permitting its positive operation in either direction, or to permit the spindle freely to rotate to enlarge the strap loop simply by pulling by hand the end wrapped around the spindle. The ratchet is then engaged to rotate and wrap a sufficient length of the strap around the spindle to engage a container and hold it firmly against rotation as housing 26 is rotated to loosen the container's twist cap oermitting the container to be opened.

It will be seen that positioning of a container 69 under the housing 26 with its cap in position to be engaged by the jaws 36 and 38, is facilitated by the telescoping arrangement of the standard 24 and it sliding adjustable connection to ring 100 as seen in FIGS. 6 and 7.

Also, it is seen that the standard 24 is provided with a pair of elongated feet 212 to stabilize the assembled opener/closer on a counter as its cap is being loosened.

Figure 3:
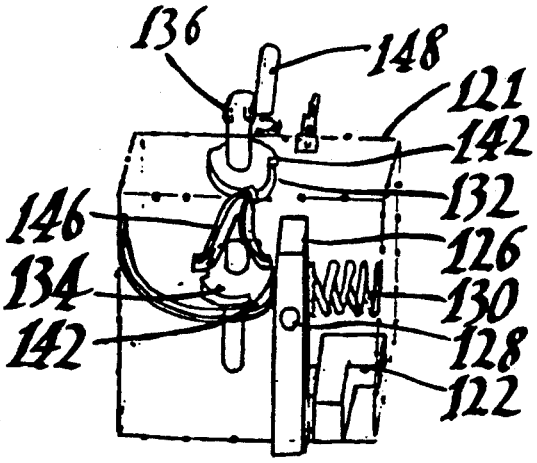
FIG. 3 is a perspective view of the intermittent striker component of the invention for assisting in the rotation of the opener to twist and loosen the cap of a container.
Figure 4:
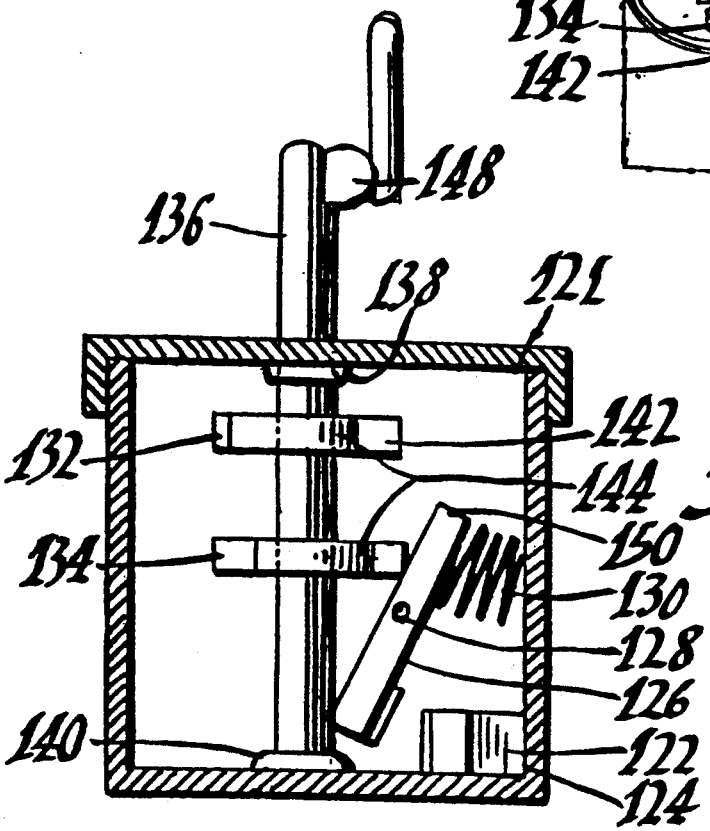
FIG. 4 is a sectional view showing the interior of the striker component and how it operates.

The cam operated striker component 22, as seen in FIGS. 1, 3 and 4, is positioned at the left end of housing 26 and secured there to the downturned end flange 32 of the housing.

Now turning to FIG. 4, it is seen that this striker component is enclosed in a housing 121, and includes: an anvil 122 fixed at 124 to the righthand wall 32 of housing 121; a striker plate 126 pivotally mounted on a horizontal shaft 128 the ends of which are mounted upon the walls of housing 121, and is normally pressed counter-clockwise by spring 130; and a pair of cams 132 and 134 mounted upon a vertical shaft 136 journalled in bosses 138 and 140 in the top and bottom walls of housing 121.

While more or less high points may be provided on the cams, preferably in this preferred form of the invention, each cam has three aligned high points 142, and three corresponding low points 144, see FIG. 3, only two of which are visible in FIG. 4. A U-shaped spring 146 is secured to the housing wall with its free end urged against the top cam 132 to counterbalance the reactive force of the striker against the anvil when the shaft is rotated by its handle 148.

In its operation, when handle 148 rotates shaft 136 the high points of cams 134 are rotated successively against the upper end 150 of striker 126 intermittently to rotate the striker clockwise moving its lower end away from contact with anvil 122, as seen in FIG. 4.

When the high points of cam 134 leave the striker it is driven in a counter clockwise direction by spring 130 thus to rotate and drive the striker's lower end forcibly against anvil 122, and consequently against opener housing 26 to which the striker housing is attached, intermittently to effect successive forceful increments of rotational movement to housing 26. At this time the U-shaped spring 146 is urged against the higher portion of the low edges of cam 134 to counteract the reacting force of the striker striking the anvil.

Normally full rotation of opener housing 26 is by means of handle 160 pivotally mounted upon the outer end 162 of U-shaped member 164, the opposite arms 166 and 168 of which are slidably mounted upon the down-turned side edges flanges 28 and 30 of housing 26 by means of the slide covers 170 and 172 secured to the side edge flanges of housing 26. Slidably moving U-shaped member 164 relative to housing 26 permits adjustment of the force to rotate the opener by handle 160, to suit the physical strength of the user.

Now turning again to FIGS. 6 and 7, it will be seen that the container component 24 of the invention is secured to ring 100 upon which opener 20 is attached by means of the depending leg 180 of plate 182. The upper ends 184 and 186 of telescoping tubes 188 and 190 are slidably mounted upon plate 182 for sliding movement relative to ring 100. Plate 183 is wider than leg 180 thus permiting the ends 184 and 186 of the telescoping tubes to pass by leg 180 when positioning the container component beneath the opener component for movement of the container's twist cap between jaws 36 and 38 for loosening its twist cap and opening the container.

Figure 8:
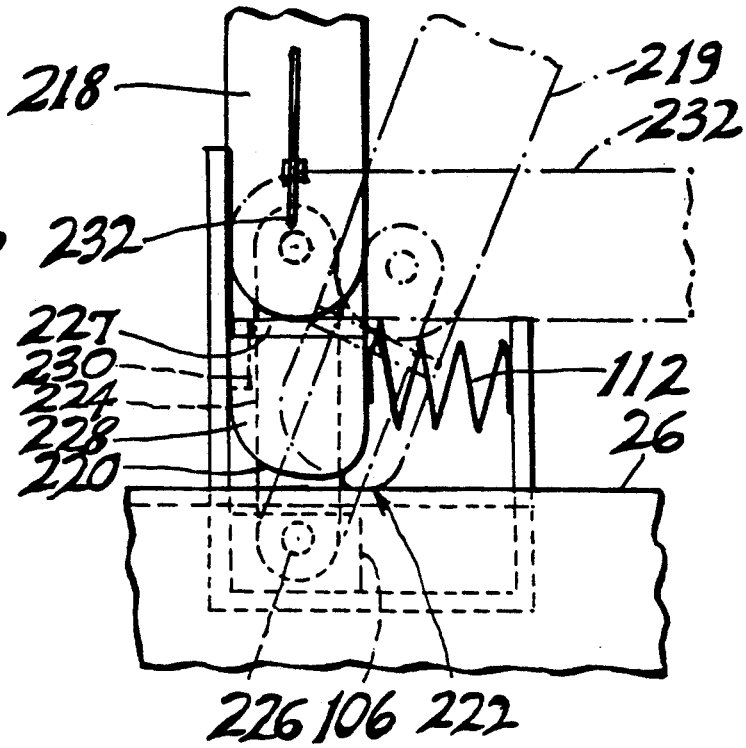
FIG. 8 is a fragmentary view illustrating a modification of a handle portion of the invention.

Now with regard to FIG. 8 illustrating a modification of the handle 70 mounting at the top of opener housing 26, as seen in FIG. 5, wherein it is pivotally mounted upon upright 106.

However, FIG. 8 modifies this arrangement to provide means folding the handle for storage and for locking the handle in its forward rotated position, thereby cancelling any possible reactive force which might cause the embedded jaw teeth in a container twist cap becomming withdrawn from the cap at that time. The construction illustrated in FIG. 8 prevents that.

As seen in this figure, when handle 218 is rotated clockwise, to the position shown in broken lines at 219, to embed the jaw teeth in a container twist cap, its bottom edge 220 becomes frictionally engaged at 222 with the top surface of opener housing 26 sufficiently to lock the handle in its rotated position, keeping the jaw teeth embedded in the cap.

This condition is effected by a pin 223 releasably attaching handle 218 to a link 224 pivotally mounted at 226 on upright 106. Also permanently secured to link 224 is a back wall 227 having a cup-shaped wall 228 forwardly spaced from the back wall but connected thereto by a link 230.

The U-shaped wall 228 is positioned with its eccentrically shaped bottom wall 220 closely spaced over the top surface of opener housing 26.

When handle 218 is pivoted clockwise to its forward position 219 to embed the jaw teeth into a container cap, the eccentrically shaped bottom edge 220 of cup-shaped member 228 has turned into frictional locking engagement with the top of housing 26, as indicated at 222, and locks the handle in that position, thus cancelling any reactive force tending to release the jaw teeth from their embedded condition in a containers twist cap.

After the cap is loosened, handle 218 may be manually returned to its at rest position shown in full lines in this figure, and then moved to the left, as described heretofore, to release the embedded jaws teeth from the cap permitting removal of its container for opening.

It will also be seen in this figure that handle 218 may be rotated free of its attachment with link 228 by removing the pin 230 connecting it to link 228, at which time the handle is free to be rotated to its stored condition 232 shown in broken lines in FIG. 9.

FIG. 9 illustrates how the various pivotal mountings of handles 118, 162, 218, the telescoping standard 24, and the foldable parts of ring 100, etc. throughout the foregoing description, facilitate the compact folding of these components of the opener/closure of this invention for its convenient and compact storage in a kitchen drawer, or alternatively its hanging upon a kitchen or other wall.

Now having described the best and preferred form of the invention, it is obvious that various changes could be made in its specific construction as described without departing from the spirit and intended scope of the invention, and that it should be considered interpreted as illustrative and not in a limited sense.

What is claimed:

1. A opener/closure for containers having twist cap closures comprising:

a substantially rectangular housing having side and end flanges and an open bottom;

a pair of interconnected jaws slidably mounted within said housing for sliding movements between and parallel with said side flanges and selectively toward and away from each other and said end flanges;

said jaws having cap gripping edges facing each other:

a handle secured to one of said jaws for manually moving said jaws simultaneously toward or away from each other whereby said gripping edges of said jaws are effective to grip or release container twist caps positioned between said jaws; and means for simultaneously rotating said housing and said jaws for loosening or tightening a container twist cap.

2. The device of claim 1 wherein:

said handle is located upon the top of said housing with one end thereof extending through a slot in the top of said housing with its inner end secured to one of said jaws.

3. The device of claim 1 wherein:

the means for interconnecting said jaws comprises:

a cable connecting at one end to one of said jaws and the other end to the other of said jaws whereby movement in either direction of said one of said jaws by said handle is effective to move the other of said jaws in the opposite direction.

4. The opener/closure of claim 1 and including:

a telescoping standard for positioning beneath said housing a twist cap container with its cap in position to be gripped by the gripping edges of said jaws.

5. The opener/closure of claim 1 wherein said means for rotating said housing and said jaws comprises:

striker means for intermittently jarring said housing in a rotation direction while gripping a twist cap.

6. The opener/closure of claim 1 wherein said means for moving said jaws to grasp a containers twist cap comprises:

a second handle slidably attached to said one side edge flange and extends from one end of said housing to provide additional means for manually rotating said housing, said second handle being slidable for adjusting the leverage force available to be exerted upon said second handle by and to suit the user of the device for rotating said housing.

7. The opener/closure of claim 1 wherein said means for moving said jaws to grasp a containers twist cap wherein:

said handle extends through a slot in the top of said housing with its inner end secured to one of said jaws;

cable means connecting said one of said jaws to the other of said jaws whereby movement in either direction of said one jaw by said handle is effective to move the other jaw in the opposite direction;

a second handle is slidably attached to said side edge flanges and extends from one end of said housing to provide additional means for manually rotating said housing, said handle being slidable for adjusting the leverage force available to be exerted upon said second handle by and to suit the user of the device for rotating said housing; and springs positioned between each of said jaws and its adjacent housing end flange thereby to oppose the movement of said jaws away from each other and simultaneously to increase their force applied to move said jaws toward each other tightly to grip a twist cap on a container positioned beneath the jaws.

8. The opener/closure of claim 1 and further comprising:

means for positioning beneath said housing a twist cap container with its cap in position to be gripped by the gripping edges of said jaws;

a ring;

means mounting said housing upon said ring for its rotational movements;

a telescoping standard slidably connected to said ring and pivotally depending therefrom; and means located at the bottom end of said standard and adjustable for tightly gripping selected containers of various sizes, and for positioning said containers beneath said housing in position for relative vertical movement to position the container with its cap to be gripped by said jaws for removal of its cap.

9. The opener/closure of claim 1 wherein:

said gripping edges of said jaws are provided with a V-shaped central portion best suitable for gripping caps of small diameter, and those portions of said gripping edges on either side of said central portions are formed with different radii best suitable for gripping caps of larger diameter; and wherein cap gripping teeth are provided upon all portions of said gripping edges, but those teeth on said V-shaped central portion being smaller than on the other edge portions.

10. The opener/closure of claim 1 wherein: only a single gripping edge is provided upon one of said jaws, and two spaced apart parallel and co-extensive grippin edges are provided upon the other of said jaws, and wherein said single gripping edge is positioned relative to said two gripping edges of the other jaw to enter between and mesh with said two gripping edges when container caps are gripped thereby.

11. The opener/closure of claim 1 wherein said means for rotating said housing and said jaws comprises:

Striker means secured to one end flange of said housing for intermittently jarring said housing in a rotating direction while gripping a twist cap;

said striker means comprising:

an anvil attached to said housing;

a pivotally mounted striker plate;

a cam having a plurality of separate high on its circumference and positioned adjacent one end of said striker plate;

a shaft upon which said cam is mounted;

a handle for rotating said shaft and consequentially said cam; and resilient means urging one end of said striker against said cam whereby as the cam is rotated by said handle the said one end of the striker rotates about its pivot against the successive high and low points of the cam thereby forcibly rotating the opposite end of said striker successively against said anvil thus to impart successive jarring forces against said housing sufficient to break the initial seal of and loosen a twist cap for opening of its container.

12. The opener/closure of claim 1 wherein the means for rotating said housing comprises:

a U-shaped member having opposite parallel arms slidably mounted upon and parallel with the opposite side edge flanges of said housing; and handle mounted upon said U-shaped member at a point between but extending away from said parallel legs for sliding said U-shaped member in directions parallel with said housing side flanges thereby making available an increasing or decreasing leverage force necessary for individuals of different strength to rotate said housing.

13. The opener/closure of claim 1 and further including:

means for positioning beneath said housing a twist cap container with its cap in position to be gripped by the gripping edges of said jaws;

a ring;

means slidably mounting said housing upon said ring for slidable rotational movements;

a standard slidably connected to said ring and pivotally depending therefrom;

means located at the bottom end of said standard and adjustable for tightly gripping selected containers of various sizes, and for positioning said containers beneath said housing in position for relative vertical movement to position said container with its cap in position to be gripped by said jaws for removal of its cap;

an adjustable length flexible strap having a container gripping surface on its inner face;

means fixing one end of said strap at the lower end of said standard; and means for extending and retracting the other end of said strap and fixing it adjacent said one end when the strap is wound around and tightly gripping a container, thus to hold the container against rotation as the housing rotates to turn the container twist cap.

14. An opener/closure for twist caps on containers comprising:

a rectangular housing having downturned side edge and end edge flanges;

a pair of jaws each having pins projecting into slots in said side flanges for slidably mounting said jaws upon the inner surfaces of said side flanges;

said jaws having cap gripping edges facing each other, and formed with a central V-shaped notch with small teeth for gripping small diameter caps, and the remaining edges on opposite sides of said central V-shaped notch being formed with different radii and having larger teeth for gripping larger diameter caps;

cable means interconnecting said jaws for slidingly moving them toward and away from each other;

accordian springs positioned between said jaws and said end flanges normally urging said jaws toward each other;

a first handle connected to one of said jaws for moving it and the other jaw apart against the pressure of said springs whereby the force of said springs is increased to move the jaws toward each other and in contact with and gripping a cap positioned between them when said first handle moving them apart is released and/or manually moved in that direction;

striker means mounted on said housing at one thereof and operable for jarring said housing in a rotating direction to loosen a cap when gripped between said jaws;

said striker comprising:

an anvil attached to said housing;

a pivotally mounted striker plate;

a cam having a plurality of high points on its circumference and positioned adjacent one end of said striker plate;

a shaft upon which said cam is mounted;

a second handle for rotating said shaft and consequently said cam;

resilient means urging one end of said striker plate against said cam whereby when said cam is rotated by said handle against the successive high points of the cam forcibly rotating the opposite end of said striker plate successively against said anvil to impart successive jarring forces against said housing sufficient to break the initial seal of and loosen a twist cap for opening of its container:

said opener/closure further including a U-shaped member slidably mounted upon and with its legs parallel with the side edge flanges;

a third handle attached to said U-shaped member for sliding it in directions toward or away from said housing thereby increasing or decreasing the leverage for rotating said housing by said handle in the hands of users of different strength;

a ring upon which said housing is mounted for its rotational movements, and having hinged portions;

means for positioning a container beneath said housing with its cap in position to be grasped by said jaws;

said last means comprising a telescoping standard having one end slidably and pivotally connected to said ring and depending therefrom, and an adjustable length strap at its opposite end operable tightly to grip a container and hold it securely against rotation as the rectangular housing is rotated in a direction to loosen or tighten a twist cap to open its container.

15. The opener/closure of claim 12 wherein said first, second and third handles, and said telescoping standard are pivotally mounted, all together with the hinged portions of said ring may be folded up compactly against said housing for storage.

* * * * *